United States Patent [19]

Wolff

[11] Patent Number: 5,038,475

[45] Date of Patent: Aug. 13, 1991

[54] TABLET CUTTER

[76] Inventor: Stephen H. Wolff, 222 E. 35th St., New York, N.Y. 10016

[21] Appl. No.: 28,970

[22] Filed: Mar. 23, 1987

[51] Int. Cl.[5] ..... B25F 3/00

[52] U.S. Cl. ..... 30/124; 225/103

[58] Field of Search ..... 30/124, 179, 120.1; 225/103

[56] References Cited

U.S. PATENT DOCUMENTS

| | | |
|---|---|---|
| D. 254,842 | 4/1980 | Berner . |
| 2,655,259 | 10/1953 | Davoren . |
| 3,175,746 | 3/1965 | Porter et al. . |
| 3,439,664 | 4/1969 | Sylvester . |
| 3,517,871 | 6/1970 | Gaffney et al. . |
| 3,650,445 | 3/1972 | Heitzman . |
| 3,815,802 | 6/1974 | Stevens . |
| 4,009,651 | 3/1977 | Adams . |
| 4,173,826 | 11/1979 | Leopoldi et al. . |
| 4,179,806 | 12/1979 | Lieptz . |
| 4,199,863 | 4/1980 | Deckert . |
| 4,330,936 | 5/1982 | Swarth . |
| 4,422,553 | 12/1983 | Hoeks et al. . |

*Primary Examiner*—Timothy V. Eley
*Assistant Examiner*—Willmon Fridie, Jr.
*Attorney, Agent, or Firm*—Roseman & Colin

[57] ABSTRACT

A device for splitting tablets has a base and a cover. A tablet to be split is held in a recess in the base, and a knife edge is provided in a corresponding recess in the cover, the recesses being larger in one dimension than the largest dimension of the tablet. Closing the cover severs the tablet while eliminating or minimizing crumbling.

9 Claims, 1 Drawing Sheet

TABLET CUTTER invention relates to a device for splitting a tablet while eliminating or minimizing crumbling thereof.

It is commonplace for pharmaceutical tablets to be scored to assist the patient in dividing the tablet into two halves. Often, however, it is difficult to break the tablet in two manually. For the elderly and feeble, many pills are hard to break. Even for persons in sound health, it is difficult to break small tablets by hand.

The present invention provides apparatus for dividing a tablet that will sharply and cleanly divide the tablet in two with a minimum of crumbling.

In particular, the present invention provides apparatus for dividing a tablet which comprises a base, a cover pivotally mounted on the base for pivotal movement to and from the base as the cover is closed and opened, respectively, the cover and the base each having planar faces that are confronting when the cover is closed, each of the faces having a recessed portion arranged such that the recessed portions are aligned when the cover is closed, each of the recesses being larger in one dimension than the largest diameter of the tablet to be divided, the recessed portion of the base being arranged to support a tablet to be divided such that a portion of the tablet projects beyond the face of the base, and knife edge means are provided in the recessed portion of the face of the cover and positioned perpendicular to the one dimension for dividing a tablet supported by the recessed portion of the base as the cover is moved to the closed position.

The present invention is illustrated in the accompanying drawing, in which.

Figure 1:
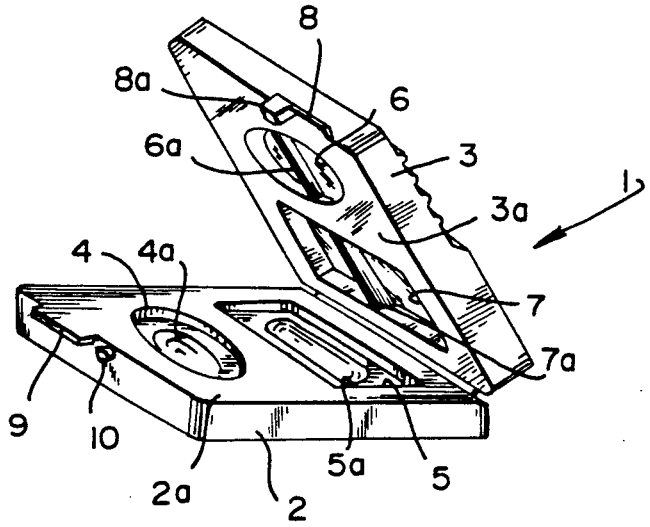
FIG. 1 is a perspective view of the tablet-dividing tool of my invention.
Figure 3:
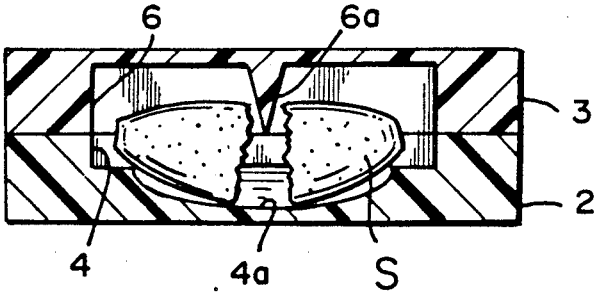
FIG. 3 is a view in section of the tool in a closed position.

FIG. 1 shows a tablet dividing tool 1 having a tablet-supporting base 2 and a cover 3 pivotally connected thereto. Base 2 and cover 3 have planar faces 2*a*, 3*a* that are in confronting relationship when the cover 3 is pivoted to the closed position. (FIG. 3). Face 2*a* has recessed portions 4,5 while face 3*a* has recessed portions 6,7. As seen in FIG. 3, the recessed portions 4,5 in face 2a are aligned with recessed portions 6,7 in face 3*a* when cover 3 is closed. It is presently preferred that the recessed portions 4–7 be oblong, even for circular tablets, but circular or square shaped recessed portions can be used.

Each of recessed portions 4,5 has a tablet-centering depression 4*a*, 5*a* therein, as will be explained in detail hereinafter. Each of recessed portions 6,7 has a knife-edge 6*a*, 7*a* therein for dividing a tablet, as will be explained below.

Figure 4:
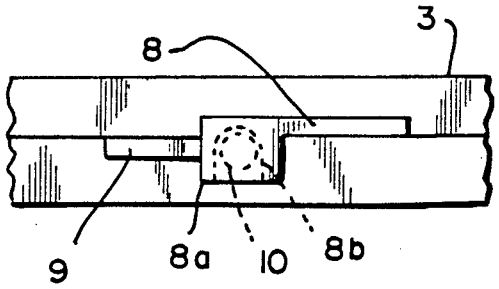
FIG. 4 is a detail view of the snap-fit locking device.

Cover 3 has a tongue 8 projecting therefrom. Depending from tongue 8 is tab 8*a*, which has a groove 8*b* (FIG. 4). Base 2 has a tongue 9 and post 10 projecting therefrom. When cover 3 is closed, post 10 is snap-fit into groove 8*b* (FIG. 4). Cover 2 can be opened by applying force to tongues 8 and 9.

Recessed portions 4,5 are arranged to support a tablet to be divided such that a portion of the tablet projects beyond the face 2*a*. Each recessed portion 4,5 is longer than the length of the tablet to be divided. Tablet-centering depressions 4*a*, 5*a* are about the length of the tablet and thus center the tablet in recessed portions 4,5. The knife-edges 6*a*, 7*a* are perpendicular to the length of the recessed portions 4,5 so that the knife-edges 6*a*, 7*a* will divide a tablet into two segments approximately equal to one-half the original length. For oblong tablets, it is customary to divide the tablets perpendicular to the length thereof, and hence the tool 1 will provide segments of a tablet in the customary form and shape.

As the cover 3 is closed, the knife-edges 6*a*, 7*a* will engage and divide a tablet in the recessed portions 4,5. Since the recessed portions 4,5 and 6,7 are longer than the tablet, the segments S (FIG. 4) are free to move laterally away from the knife edge 6*a*, 7*a* as it enters the tablet to split the same. The tablet splits sharply and cleanly, with a minimum of crumbling, because the severed segments are free to move laterally away from the knife-edge 6*a*, 7*a* and toward the ends of recesses 4,6 and 5, 7 during the splitting operation, and the severed segments are stored in the chamber formed by the aligned recessed portions 4,6 and 5,7.

The snap-fit action of members 8*a* and 10 assist in insuring proper operation of tool 1. The "click" sound of members 8*a* and 10 as they snap together provides a signal that the tablet-dividing operation is concluded. The snap-fit action of members 8*a* and 10 thus provide the tool 1 with a "go no-go" operation. Thus, when the user applies sufficient force to close the tool 1, the tablet will be properly divided. If the "click" is not heard, the user will know that the tablet has not been divided and he will continue to squeeze the lever 3 until it closes.

It is presently preferred to provide a pair of recessed portions 4,6 and 5,7 to accommodate tablets of two different configurations. Thus, tablets of an elliptical shape can be placed in recessed portion 4 while those of a rectangular shape are placed in recess 5.

It is a particular advantage of the present invention that the tool 1 can be formed in one operation by a plastics molding process, such as injection molding. The base 2 and cover 3 are thus integrally connected together with the recessed portions 4–7, knife edges 6*a*, 7*a* and interlocking members 8, 8*a*, 8*b*, 9 and 10 all being formed in a single molding operation. The tool 1 thus avoids complex molding techniques in which a knife is preformed and then assembled into a molded part. The tool 1 also avoids the cost of assembling separate pieces together.

Figure 2:
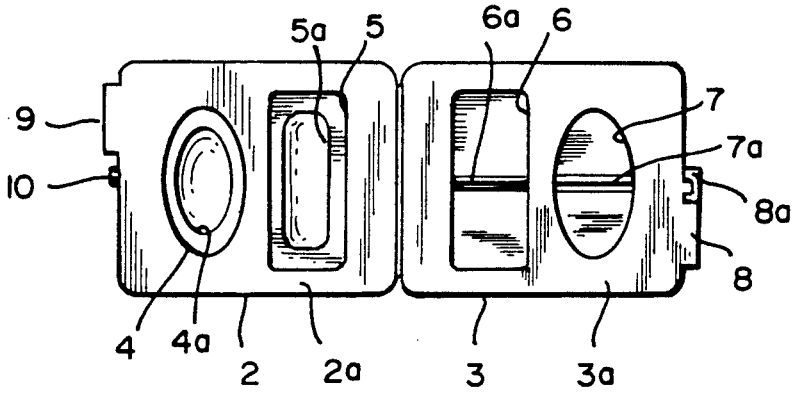
FIG. 2 is a plan view of the tool in the fully open position.

As is seen from FIGS. 1–3, when tool 1 is closed, the device is compact and can be stored in a pocket, the tool not being much larger than the pills to be supported in recessed portions 4,5. Further, since recessed portions 4–7 are provided in the base 2 and cover 3, the tool 1, when closed, is not much thicker than a tablet.

I claim:

1. Apparatus for dividing a tablet, which comprises a base, a cover pivotally mounted on said base for pivotal movement to and from said base as said cover is closed and opened, respectively, said cover and said base each having planar faces that are confronting when said cover is closed, each of said faces having a recessed portion arranged such that said recessed portions are aligned when said cover is closed, each of said recesses being larger in one dimension than the largest diameter of the tablet to be divided, said recessed portion of said base being arranged to support a tablet to be divided such that a portion of said tablet projects beyond the face of said base, and knife edge means in said recessed portion of said cover face fixedly mounted on said cover, said knife edge means being positioned perpendicular to said one dimension for dividing a tablet supported by said base recessed portion as said cover is moved to said closed position.

2. Apparatus according to claim 1, wherein each of said faces have two sets of said recessed portions.

3. Apparatus according to claim 2, wherein one set of recessed portions in said faces of said base and cover is elliptical and the other is rectangular.

4. Apparatus according to claim 1, wherein said base and cover have snap-fit means for locking said cover and base together when the cover is completely closed and means for unlocking said snap-fit means.

5. Apparatus according to claim 1, wherein said recessed portion of said face of said base includes means for centering a tablet in said recessed portion.

6. Apparatus according to claim 5, wherein said centering means is provided by a depression in said recessed portion.

7. Apparatus according to claim 3, wherein each recessed portion in said face of said base includes means for centering a tablet therein.

8. Apparatus according to claim 7, wherein said centering means is provided by a depression in said recessed portion.

9. Apparatus for dividing a tablet, in the form of a one-piece plastic molding which comprises a base, a cover pivotally mounted on said base for pivotal movement to and from said base as said cover is closed and opened, respectively, said base and cover being integrally connected together, said cover and said base each having planar faces that are confronting when said cover is closed, each of said faces having a recessed portion arranged such that said recessed portions are aligned when said cover is closed, each of said recesses being larger in one dimension than the largest diameter of the tablet to be divided, said recessed portion of said base being arranged to support a tablet to be divided such that a portion of said tablet projects beyond the face of said base, and knife edge means in said recessed portion of said cover face and positioned perpendicular to said one dimension for dividing a tablet supported by said bse recessed portion as said cover is moved to said closed position, said knife edge means being integral with said cover.

* * * * *